United States Patent [19]

Helmrich et al.

[11] 3,970,184

[45] July 20, 1976

[54] MOSAIC PRINTING HEAD FOR TYPEWRITERS OR SIMILAR MACHINES

[75] Inventors: Hans Helmrich, Geisenbrunn; Max Guntersdorfer, Zorneding, both of Germany

[73] Assignee: Siemens Aktiengesellschaft, Berlin & Munich, Germany

[22] Filed: Aug. 1, 1974

[21] Appl. No.: 493,555

[30] Foreign Application Priority Data

Aug. 20, 1973 Germany ..... 2342021

[52] U.S. Cl. ..... 197/1 R; 310/8.7; 310/26

[51] Int. Cl.[2] ..... B41J 3/10

[58] Field of Search ..... 197/1 R; 101/1, 93.04; 310/8, 26, 8.7; 346/141

[56] References Cited

UNITED STATES PATENTS

| | | | |
|---|---|---|---|
| 2,565,158 | 8/1951 | Williams | 310/8.7 |
| 2,587,482 | 2/1952 | Keller | 310/8.7 X |
| 3,112,693 | 12/1963 | Williams | 197/1 R X |
| 3,151,543 | 10/1964 | Preisinger | 310/26 X |
| 3,386,551 | 6/1968 | D'Onofrio | 197/1 R |
| 3,408,220 | 10/1968 | Bendix et al. | 117/37 |
| 3,473,466 | 10/1969 | Thayer | 310/26 X |
| 3,822,005 | 7/1974 | Murat | 197/1 R |

*Primary Examiner*—Ralph T. Rader
*Attorney, Agent, or Firm*—Hill, Gross, Simpson, Van Santen, Steadman, Chiara & Simpson

[57] ABSTRACT

A mosaic printing head for typewriters, data printers, teleprinters and the like, utilizing dot-producing pin-like printing elements for recording characters in the form of a dot pattern upon a data carrier, employing a plurality of dot forming elements, each of which is adapted to be actuated by an elongated, piezoelectric transducer which is subjected to electric fields in rapid succession to effect changes in the length of each transducer and thereby produce driving forces upon the associated element.

4 Claims, 2 Drawing Figures

MOSAIC PRINTING HEAD FOR TYPEWRITERS OR SIMILAR MACHINES

BACKGROUND OF THE INVENTION

The invention is directed to a mosaic printing head for typewriters, data printers, teleprinters and the like, employing spot-producing, pin-like printing elements for recording on a data carrier characters formed from elements of a dot raster.

Mosaic printing heads of this general type have a fundamental advantage in comparison to printing devices which include all the type images, of the characters involved, on the printing members, in that considerably less time is required for the printing of the individual characters, whereby it is possible to achieve higher printing speeds. Furthermore, such an arrangement has a very low level of operating noise. The high printing speed achieved, in comparison to overall type printing, results from the omission of setting movements required when type rollers or type heads are employed in the actual printing movement of the type carrier upon the data carrier, resulting from the reduction of the masses which must be accelerated and decelerated in each printing operation, as well as by the small distances traveled by the printing elements.

An expensive item in the utilization of the known mosaic printing head arrangements employing dot-producing printing elements, are the drive elements for the respective printing elements, an individually operable electromagnetic arrangement being required for each individual printing element. Such electromagnetic arrangements are relatively large in overall size which necessitates a division with respect to the juxtaposed dot-producing printing elements and thus imposes a considerable load on the type carrier carriage which normally moves along a line during the printing operation.

BRIEF SUMMARY OF THE INVENTION

The present invention is directed to the production of a mosaic printing head employing dot-producing, pin-shaped printing elements of space-saving design and the masses of which required to be moved and accelerated are as small as possible.

This objective is realized in such a printing head by means of an arrangement in which elongated, piezoelectric transducers, which may be subjected to different electric fields in rapid sequence, actuate the dot-producing juxtaposed printing elements.

The utilization of a printing head embodying these features, in accordance with the invention, results in a considerable reduction in the overall size of the printing head, and in addition to reducing the space required therefor and a reduction in the masses supported on the type carrier, which are to be moved, accelerated and decelerated, the arrangement has the particular advantage that the elements which actuate the dot-producing printing elements, in the present instance the piezoelectric transducers, can be positioned or staggered more closely than in known electromagnet arrangements. It is even possible to arrange the piezoelectric transducers behind the juxtaposed, dot-producing pin-shaped printing elements at a spacing corresponding to the interval between such elements, thereby resulting in a further simplification of the construction, as in this case the guides of the individual dot-producing printing elements can be aligned in rectilinear fashion with respect to the printing position or location.

As in the case of electromagnetic arrangements for actuating dot-producing printing elements of the mosaic printing head, when employing piezoelectric transducers therefor, only the appropriate number of electrical supply lines from the stationary character generator to the mosaic printing head moving along the line are required. Piezo-ceramics advantageously are employed as the piezoelectric transducers. Such piezoceramics may be produced in very simple manner and have approximately the same properties as a piezoelectric element which consists of a single crystal.

While the changes in length which may be achieved by varying the electric fields connected to the piezoelectric transducers, are very small, the forces occurring are correspondingly large. A corresponding translation of the operative stroke to the dot-producing printing elements consequently is both necessary and possible.

In accordance with a preferred embodiment of the invention, which takes such facts into consideration, the mosaic printing head is characterized in that the ends of the dot-producing printing elements remote from the printing ends thereof are spring biased into operative engagement with elongated piezoelectric transducers. The spring elements are so dimensioned that the applied spring forces are considerably less than the forces which act on the dot-producing printing elements during the elongation of the piezoelectric transducers resulting from corresponding changes in the electric fields acting thereupon.

In one preferred design, the change in length of the piezoelectric transducer, as a result of changes in the applied electric field, causes the dot-printing elements to be rapidly accelerated towards the printing position, and as a result of their natural mass inertia, the printing elements move on to the printing position or location. Following the printing operation, they return to their initial position on the piezoelectric transducer by means of rebound energy and the spring means associated therewith.

In accordance with another preferred embodiment of the invention, the piezoelectric transducer is so constructed that it surrounds a chamber filled with an incompressible fluid and is sealed by a piston or membrane system which acts on the dot producing printing elements, with the piezoelectric transducer being provided on its inner and outer walls with electrode platings serving to supply the field voltage. Thus a change in the voltage applied to the piezoelectric transducer will result in an elongation or contraction of the transducer structure and thus an enlargement or reduction in the chamber surrounded by the transducer.

In the latter arrangement, the translation movement from the piezoelectric transducer to the dot-producing printing element takes place in a very simple manner without losses. Preferably, the dot-producing printing element per se closes the chamber surrounded by the piezoelectric transducer with the inner end disposed in the chamber thus forming a piston.

BRIEF DESCRIPTION OF THE DRAWINGS

In the drawings wherein like reference characters indicate like or corresponding parts.

DETAILED DESCRIPTION OF THE INVENTION

Figure 1:
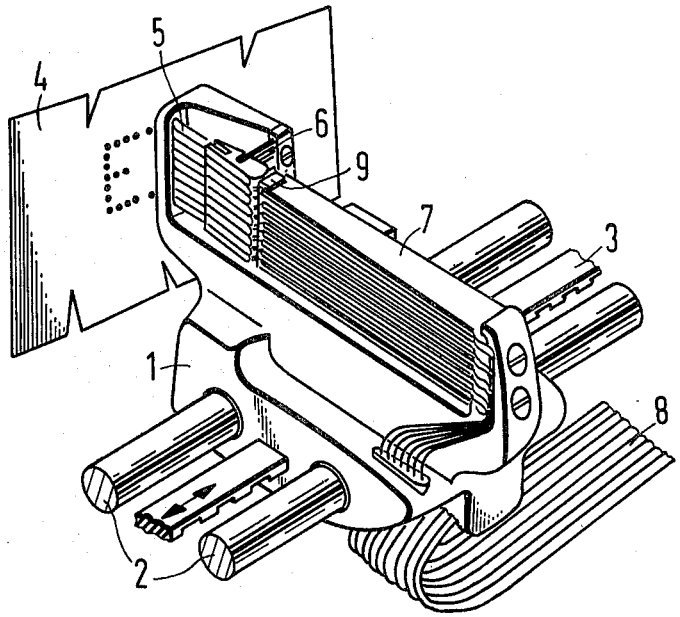
FIG. 1 is an isometric figure illustrating a mosaic printing head employing piezo-ceramics as actuating means for the respective individual printing elements.

Referring to FIG. 1, a mosaic printing head 1 is schematically illustrated as being movably mounted on guide rails 2, whereby it may be moved, during the printing operation, by means of a belt 3 along the printing line adjacent the data carrier 4. The mosaic printing head 1 carries a plurality of dot-producing printing elements 5, illustrated as being disposed in a row one above the other. Each of such dot-producing elements is urged into engagement with a cooperable piezoelectric ceramic 7, by means of a corresponding spring member or element 6. As illustrated, the piezoelectric ceramics 7 are of flat, elongated configuration whereby they can be arranged on the printing head in a spacing corresponding to the spacing between dot-producing printing elements 5, and thus in alignment with the latter. The opposite sides of each piezoelectric ceramic 7 carries suitable electrode platings or coatings by means of which the appropriate electric fields are applied thereto. Such operation is effected over electrical supply lines 8 from a suitable electronic device, not illustrated, which is constructed as a stationary part of the printing device.

By rapidly changing the electric field, applied over the cooperable electrodes, to a piezoelectric ceramic, a pulse-like elongation of a piezoelectric ceramic is effected. Thus, movement of the dot-producing printing element 5 associated therewith is initiated, with the element being accelerated towards the printing location. Following such acceleration phase of the dot-producing printing element 5, which is limited by the relatively low ability of the piezoelectric ceramic 7 to change its length, the dot-producing printing element continues to move on toward the printing position as a result of its mass inertia, and following the dot-printing thereby, returns to its initial position as a result of its rebound energy and the applied force of the associated spring element 6.

Disposed between each dot-producing printing element 5 and the associated piezoelectric ceramic 7 is a shoe 9, constructed, for example, of plastic, particularly duroplastic, which thus acts to protect the impact points of the structure. The printing element 5 is widened adjacent such shoe whereby the inert mass of the printing element 5 is increased and the operative surface enlarged.

Figure 2:
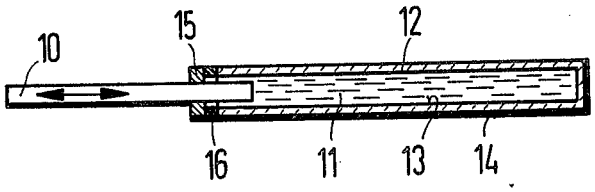
FIG. 2 is a sectional view illustrating an arrangement employing a piezoelectric ceramic in which the individual dot-producing printing element is actuated by means of a hydraulic medium.

FIG. 2 illustrates another exemplary embodiment of the invention in which a dot-producing printing element 10 may be actuated by means of an incompressible fluid 11 acted upon by a piezoelectric ceramic 12. The latter forms a chamber which contains the fluid 11 and is provided on the internal and external surfaces of its walls with electrode platings 13, 14 by means of which the electric operating voltage is applied to produce the operating electric field and the piezoelectric ceramic. Upon a change in the electric field connected to such ceramic, a contraction or expansion will occur which is transmitted through the incompressible fluid upon the dot-producing printing element 10 which is supported for longitudinal movement in a guide plate 15, the latter being connected to the piezoelectric ceramic 12 by means of an elastic intermediate component 16.

As in the construction of FIG. 1, the printing elements 10 may be suitably biased by resilient means which is cooperable with the rebound energy to return the printing element to its initial position.

Having thus described our invention it will be obvious that although various minor modifications might be suggested by those versed in the art, it should be understood that we wish to embody within the scope of the patent granted hereon all such modifications as reasonably, and properly come within the scope of our contribution to the art.

We claim as our invention:

1. A mosaic printing head for typewriters, data printers, teleprinters and the like utilizing dot-producing, pin-like elements for recording characters in the form of elements of a dot pattern upon a data carrier, comprising a plurality of like dot-producing printing elements disposed in adjacent parallel relation in a straight row extending transversely to the line of printing involved, and defining the maximum height of the characters to be formed with at least some of the characters comprising selected dots of a plurality of successively formed rows of dots produced by said elements, like piezoelectric transducers for the respective printing elements, each transducer comprising an elongated, flat, relatively thin piezoelectric member having opposite sides of relatively large area, and relatively small edge and end areas, the opposite sides of each member carrying respective electrode layers for applying electric fields to the member for effecting elongation and contraction thereof, said transducer members being disposed in stacked substantially parallel relation with corresponding ends and edges disposed substantially in respective common planes, and the electrode layers of adjacent members disposed in opposed relation, the respective transducer members having a thickness such that each of the latter are disposed in longitudinal alignment with its cooperable printing element, each printing element having an operational travel greater than the elongation-contraction dimension of the cooperable transducer member in such operational direction, and being relatively freely movable in said operational direction with respect to and independently of the cooperable transducer member, with the end of the latter disposed to transmit driving forces to the cooperable printing element in response to predetermined movement of such transducer member, as the result of the application of a corresponding field to such electrodes, whereby such printing element is accelerated toward such a data carrier, and resilient means for urging each printing element in a direction toward its cooperable transducer member, said resilient means exerting forces upon the printing elements which are considerably lower than the driving forces acting thereon by the action of the cooperable transducer members as a result of changes in the electric fields to which they may be subjected.

2. A mosaic printing head according to claim 1, wherein a shoe of plastic material is interposed between each of the individual dot-producing printing elements and the respective cooperable piezoelectric transducers.

3. A mosaic printing head for typewriters, data printers, teleprinters and the like utilizing dot-producing, pin-like elements for recording characters in the form of elements of a dot pattern upon a data carrier, comprising a plurality of like dot-producing printing elements disposed in adjacent parallel relation in a straight row extending transversely to the line of printing involved, and defining the maximum height of the characters to be formed, with at least some of the characters comprising selected dots of a plurality of successively formed rows of dots produced by said elements, like piezoelectric transducers for the respective printing elements, each transducer comprising an elongated, relatively narrow hollow piezoelectric member forming a correspondingly shaped chamber open at one end, an incompressible fluid filling said chamber, a member movable in and operatively closing the open end of such chamber, electrode surfaces carried by the inner and outer walls of such piezoelectric transducer forming field-producing means, whereby upon predetermined change in the electric field applied thereto, reduction in the volume of said chamber will take place, effecting displacement of said fluid, and thereby move said closure member in a direction out of said chamber, each of said closure members being arranged to impart movement to a respective printing element, said transducer members being disposed in stacked substantially parallel relation with their ends and their axes disposed in respective common planes and the external electrode surfaces of adjacent members disposed in opposed relation, the respective transducer members having a thickness such that each of the latter are disposed in longitudinal alignment with its cooperable printing element, each of the latter having an operational travel greater than the elongation contraction dimension of the cooperable transducer member in such operational direction, and being relatively freely movable in said operational direction with respect to and independently of the cooperable transducer member, whereby, upon application of said predetermined field to such electrodes, such printing element is accelerated toward such a data carrier, and resilient means for urging each printing element in a direction toward its cooperable transducer member, said resilient means exerting forces upon the printing elements which are considerably lower than the driving forces acting thereon by the action of the cooperable transducer members as a result of changes in the electric fields to which they may be subjected.

4. A mosaic printing head according to claim 3, wherein said closure member comprises the adjacent end of the dot-producing printing element with such element thus forming a piston in such chamber.

* * * * *